US007410275B2

(12) United States Patent
Sommers et al.

(10) Patent No.: US 7,410,275 B2
(45) Date of Patent: Aug. 12, 2008

(54) REFRACTIVE OPTIC FOR UNIFORM ILLUMINATION

(75) Inventors: Mathew Sommers, Sagamore Hills, OH (US); Mark E. Kaminski, Tucson, AZ (US)

(73) Assignee: Lumination LLC, Valley View, OH (US)

( * ) Notice: Subject to any disclaimer, the term of this patent is extended or adjusted under 35 U.S.C. 154(b) by 321 days.

(21) Appl. No.: 10/946,387

(22) Filed: Sep. 21, 2004

(65) Prior Publication Data

US 2006/0061999 A1 Mar. 23, 2006

(51) Int. Cl.

| | |
|---|---|
| ***F21V 5/04*** | (2006.01) |
| ***F21V 5/00*** | (2006.01) |
| ***F21S 13/00*** | (2006.01) |

(52) U.S. Cl. ..... 362/335; 362/311; 362/366; 362/257

(58) Field of Classification Search ..... 362/153.1, 362/310, 257, 267, 431, 311, 335, 364, 366
See application file for complete search history.

(56) References Cited

U.S. PATENT DOCUMENTS

| | | | | |
|---|---|---|---|---|
| 3,774,021 | A * | 11/1973 | Johnson | 362/27 |
| 6,530,675 | B1 * | 3/2003 | Van Etten | 362/267 |
| 6,598,998 | B2 * | 7/2003 | West et al. | 362/307 |
| 6,679,621 | B2 * | 1/2004 | West et al. | 362/327 |
| 2006/0285351 | A1 * | 12/2006 | Erber et al. | 362/556 |

FOREIGN PATENT DOCUMENTS

| | | |
|---|---|---|
| WO | WO 99/09349 | 2/1999 |
| WO | WO 03/048637 | 6/2003 |
| WO | WO 2004/032250 | 4/2004 |

* cited by examiner

*Primary Examiner*—John A Ward
(74) *Attorney, Agent, or Firm*—Fay Sharpe LLP

(57) ABSTRACT

An apparatus for distributing light from a light source includes a support and an optic supported by the support. The optic includes a truncated axially symmetric body.

15 Claims, 4 Drawing Sheets

REFRACTIVE OPTIC FOR UNIFORM ILLUMINATION

BACKGROUND OF THE INVENTION

A light emitting diode (LED), or other point light source, pointed towards the center of a target area positioned at close range from the light source creates a higher irradiance level on the target in areas closer to the LED. If uniform light intensity across the target area is desired, optical control of the light emitting from the light source can be employed.

Known optics for LEDs collect the light from the LED and direct the light in a circular or elliptical pattern. These known optics are used to create narrow to medium beam angle distributions of light. Since the optics create only narrow to medium beam angle distributions of light, these known optics create a hotspot directly in front of the LED, thus making it difficult to create large area uniform beam patterns at close range.

It is desirable to provide an apparatus that can distribute a desired beam pattern.

SUMMARY OF THE INVENTION

An apparatus for distributing light from a light source includes a support and an optic supported by the support. The optic includes a truncated axially symmetric body.

A method for illuminating a target plane includes the following steps: placing an optic cover over a light source, passing light from the light source through the optic onto the target plane, and directing light from the light source directly onto the target plane bypassing the optic. The optic in the method includes a truncated generally axially symmetrical body.

An assembly for directing light includes a support and an optical body mounted to the support. The optical body includes a truncated generally axially symmetrical peripheral wall and at least one other peripheral wall abutting the truncated generally axially symmetric peripheral wall.

DETAILED DESCRIPTION OF THE PREFERRED EMBODIMENT

Figure 1:
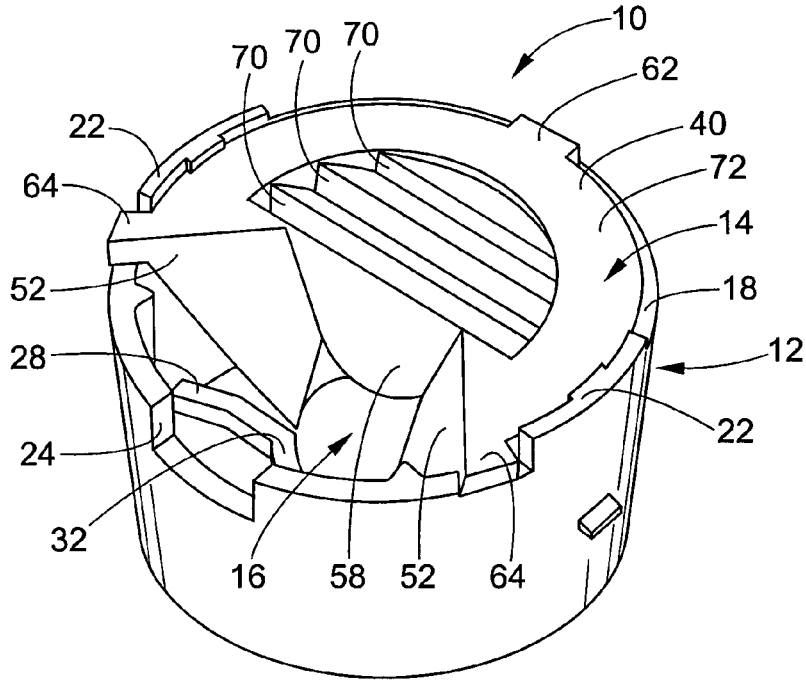
FIG. 1 is a perspective view of an optic and optic holder supporting the optic.

Referring to FIG. 1, an apparatus 10 for distributing light from a light source includes an optic holder 12 that supports an optic 14 that collects and distributes light generated by a light source 16, such as an LED. The apparatus 10 can be used with other light sources; however, for the sake of brevity it will be described for use with an LED. The optic 12 and optic holder 14 allow for the use of a combination of first incident light and refractive control of a majority of the light from the LED 16 to create a desired beam pattern on a closely located target plane, i.e., a target plane approximately four to ten inches from the LED.

The optic holder 12 supports the optic 14. The optic holder 12 includes a generally cylindrical side wall 18 that surrounds the optic 14. Two projections 22 extend upwardly from the cylindrical side wall 18 and are spaced approximately 180° from one another. The projections 22 are bisected by an axis, which will be referred to as the y-axis. Two notches 24 are formed in the cylindrical side wall 18 spaced 180° from one another and 90° from the projections 22. The notches 24 are bisected by an axis that will be referred to as the x-axis. The projections 22 and the notches 24 facilitate mounting of the optic 14 to the optic holder 12, which will be described in greater detail below.

The optic holder 12 also includes first and second base walls 26 that are symmetrical along the y-axis. Each base wall 26 includes a contoured edge 28 spaced from the y-axis. Each contoured edge 28 includes a circular portion 32 having a radius emanating from a z-axis, which is perpendicular to the x and y axes and is the axis of symmetry for the cylindrical side wall 18. The LED 16 is received between the circular portions 32 to align with the z-axis. The optic holder 12 can also include axial ridges 34 formed on an inside surface of the cylindrical side wall 18.

The optic 14 is made from a truncated generally axially symmetric body 40 that can include an ellipsoid, a paraboloidal segment, a cone, portions of the afore-mentioned as well as other axially symmetric shapes. The body is truncated in that its axial symmetry is truncated. The body 40 is truncated in that a section 42 is removed from the body to allow first incident light from the LED 16 to be directed front of the LED without passing through the optical body 40. In the depicted embodiment, the removed section is throughout the body, i.e., from the top to the bottom. The optical body 40 can be formed such that the removed section is provided during forming, e.g., the mold in which the body is formed is shaped such that the removed section 42 need not be removed from the body. The optical body 40 can be made from optical grade acrylic or other suitable material.

The optical body 40 includes a truncated axially symmetric peripheral side wall 44. An upwardly extending cup-shaped recess 46 is formed at a lower end of the optical body 40. The recess 46 is also axially symmetric about the z-axis, with the exception of a portion of the recess that would extend into the removed area 42. The LED 16 fits into the recess 46. A concave portion 48 depends downwardly from the body 40 into the recess 46. The concave portion 48 is also symmetrical about the Z axis, with the exception of a portion of the concave portion that would extend into the removed section 42. The concave portion 48 can define a light entry surface for the optical body 40.

The peripheral side wall 44 abuts outer planar walls 52 that are symmetrical to the x-axis of the apparatus 10. The outer walls will be described as planar; however, they can take other configurations. The planar side walls 52 extend from a top 54 of the optical body 40 to a bottom 56 of the body 40, which is adjacent the surface into which the recess 46 is formed. An intermediate planar wall 58 spans the outer planar walls 52. The intermediate planar wall 58 also extends from the top 54 of the optical body 40 into the recess 46 ending at the concave portion 48 of the optical body. The intermediate planar wall 58 is substantially parallel to the y-z plane and nearly aligned with the y-axis. The planar surfaces 52 and 58 are appropriately shaped to allow direct incident light to bypass the optical body 40 en route to the target area. The planar surfaces 52 and 58 can include a surface finish that is translucent, but not transparent, for example, the surface can be glazed. The planar surfaces can also be metallized to create a reflective portion. Texture, paint, such as white paint, and other diffuse patterns can be provided on the planar surfaces.

Figure 2:
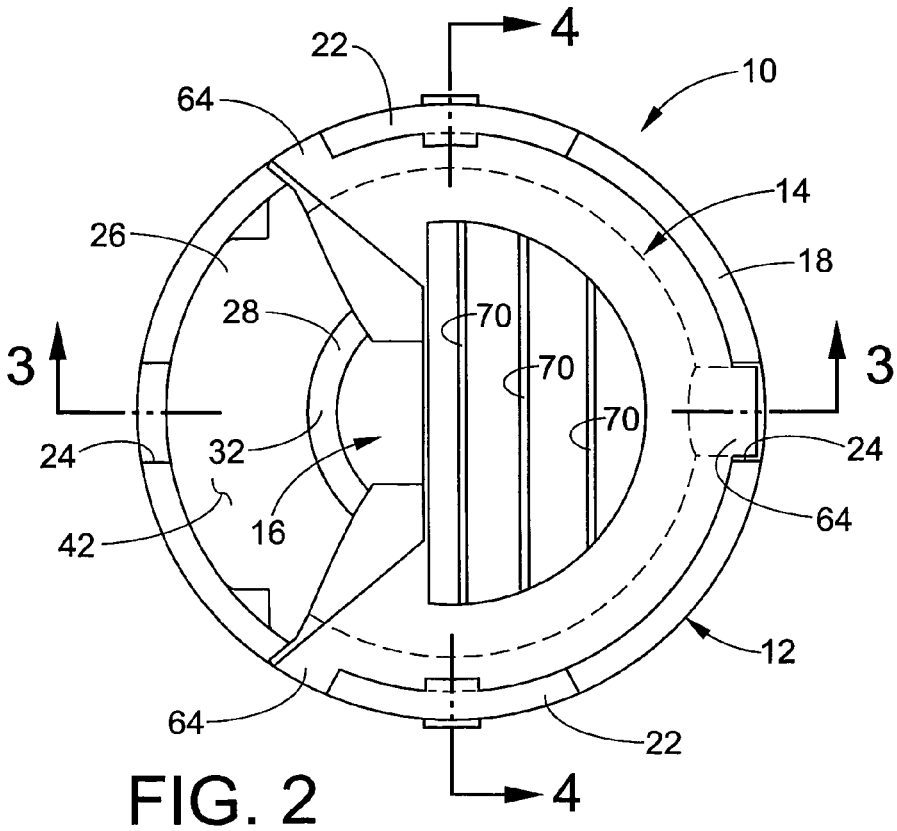
FIG. 2 is a top view of the optic and optic holder of FIG. 1.

The optical body 40 also includes a first or central projection 62 that extends off of the top surface 54 of the body along the x-axis. The central projection 62 is dimensioned to be received in either of the notches 24. The optical body 40 also includes two tabs 64 circumferentially spaced from the projection 62 and each other. The tabs 64 also extend outwardly from the top surface 54 of the optical body 40. The tabs 64 align with the planar side walls 52. The tabs 64 engage the projections 22 on the cylindrical side wall 18 when the optical body 40 is mounted to the optical holder 12. The cylindrical side wall 18, the projections 22 and notches 24 are symmetrical such that the optic 14 can be mounted one of two ways, either in the configuration depicted in FIG. 2 where the central projection 62 is received in the right notch 24 of the cylindrical side wall 18 or the optic 14 could be mounted such that the central projection 62 is received in the left notch 24, where the optic would be in a configuration rotated 180° from the configuration shown in FIG. 2.

The optic 14 also includes a plurality of facets 70, which can include Fresnel optics, formed in the top light-emitting surface 54 that are surrounded by a flat partially circular surface 72. The facets 70 are formed in a substantially semicircular area of the top 54 of the body 40. In this embodiment the facets are generally parallel with the y-axis and are shaped to direct light away from the removed section 42 of the optical body 40.

Figure 5:
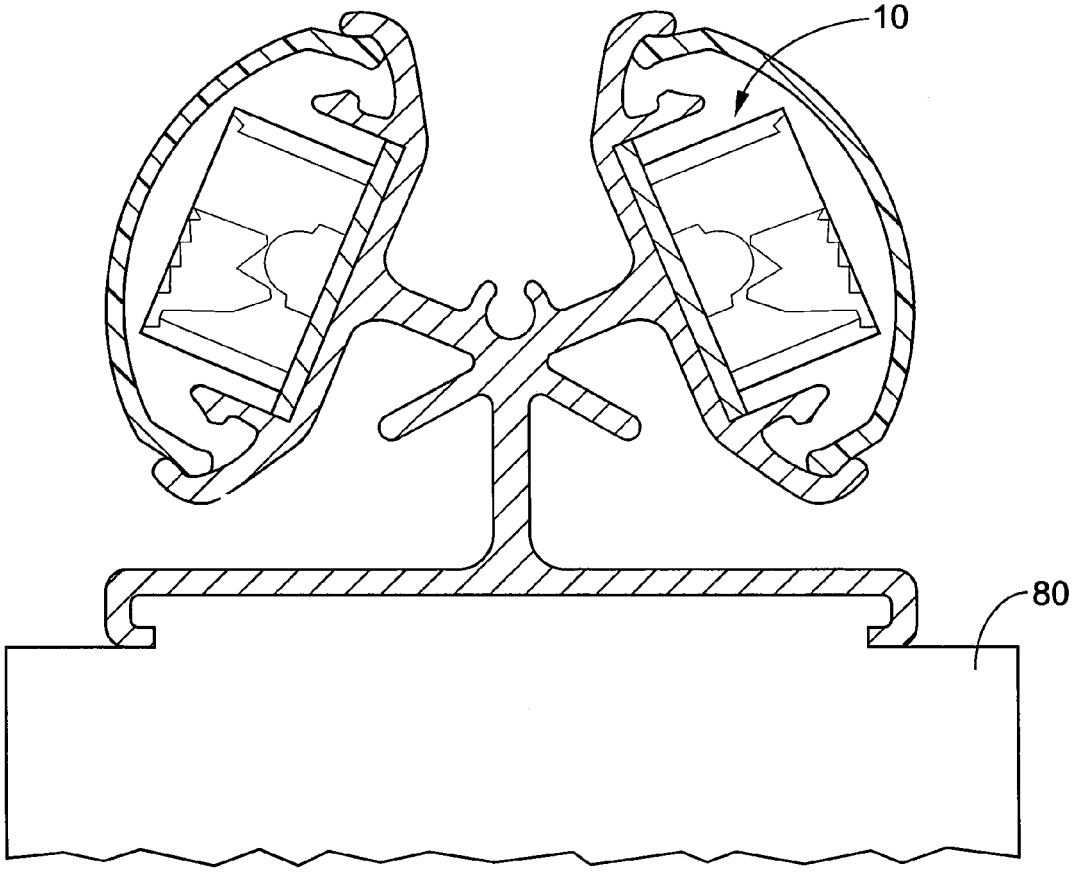
FIG. 5 is a top view of an optic and optic holder mounted to a mullion.
Figure 6:
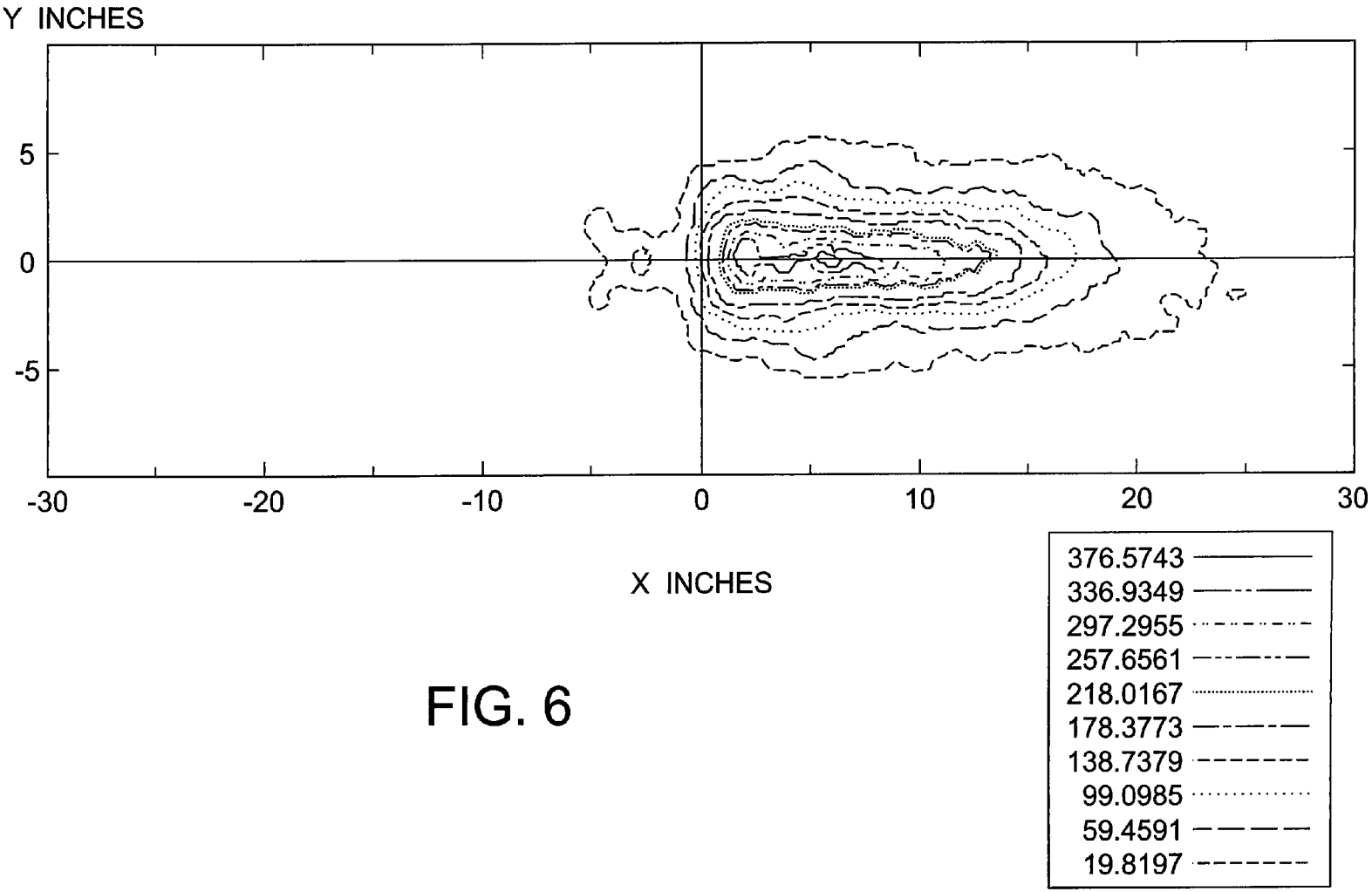
FIG. 6 depicts iso-contours of light flux across a target area.

Not to be bound by this particular application, as depicted in FIG. 5, the apparatus 10 is particularly useful in lighting products in commercial refrigeration applications. In a typical commercial refrigerator, a light source can mount to a vertical mullion 80. Since the mullion is not typically spaced from the shelf upon which the refrigerated item is stored, the light needs to be distributed to a closely located target plate, i.e., the shelf, in an efficient manner. It is also desirable to direct light away from the mullion since refrigerated products are not typically stored directly behind the mullion and any light that is directed behind the mullion is in a sense wasted. Not to be bound by the configuration disclosed, however, such a configuration was tested by directing the optic 14 towards the center of a target plane 5.5 inches away from the LED, as measured perpendicular to the target plane. The iso-contours (shown in Lux (Lx)) depicted in FIG. 6 show moderate uniformity across the entire beam pattern with the light being directed away from the mullion, which is indicated at 0 inches on the x-axis. The vertical swath of light being generally 10 inches in the horizontal swath of light being generally 20 inches.

Figure 3:
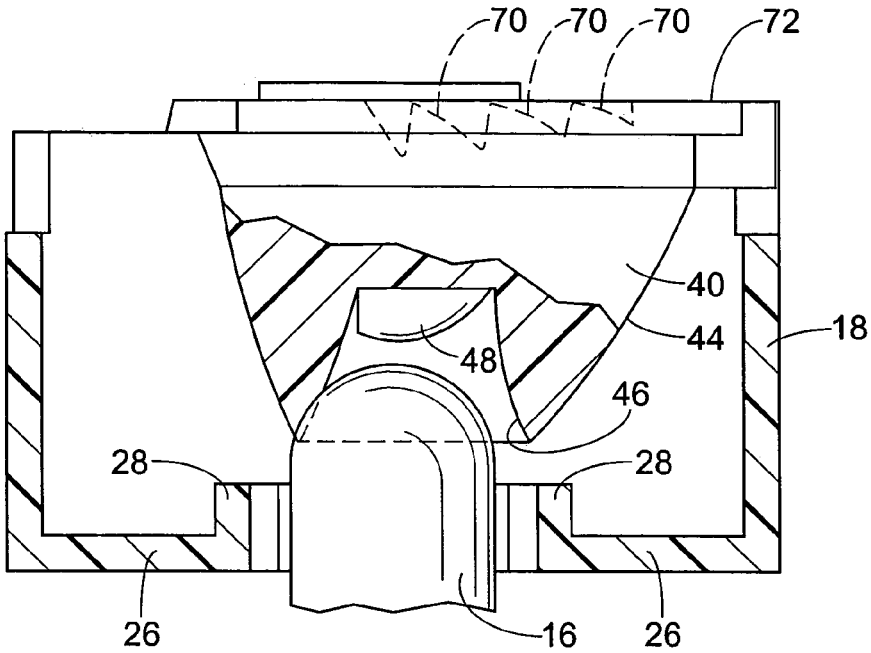
FIG. 3 is a partial cross-sectional view of the optic and optic holder of FIG. 1 through line 3-3 in FIG. 2.
Figure 4:
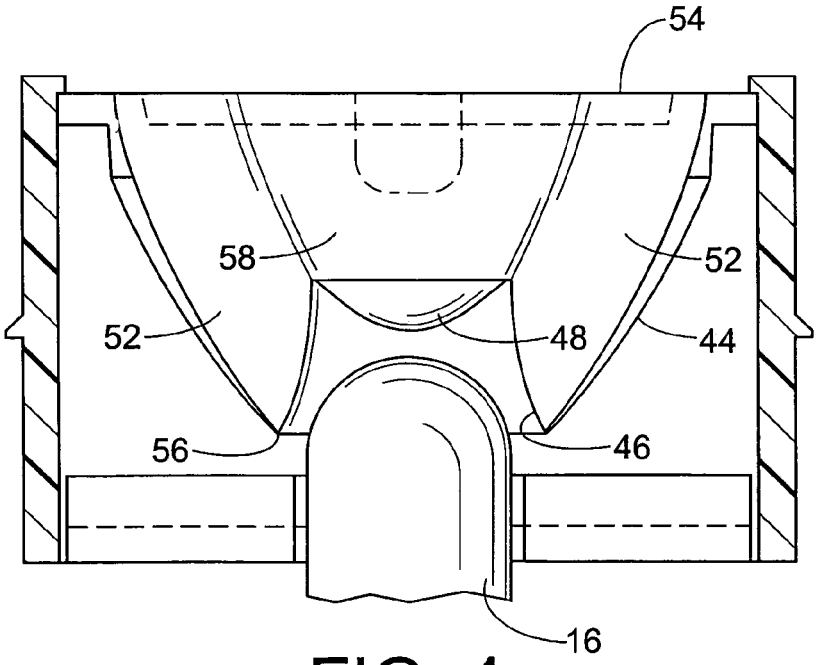
FIG. 4 is a cross-sectional view of the optic and optic holder of FIG. 1 through line 4-4 in FIG. 2.

In this particular embodiment, the light from the light source 16 travels through a number of different paths toward the target which can be explained with reference to FIG. 3. To illuminate the center of the target, light from the light source 16 refracts through the surface defined by the cup-shaped recess 46 and then reflects by total internal reflection (TIR) off the surface defined by the peripheral side wall 44, and then passes through the flat top surface 72 towards the center of the target. Some light from the light source 16 refracts through the surface defined by the concave portion 48 and then passes through the flat top surface 72 towards the center of the target.

To illuminate the target area directly in front of the light source 16, light bypasses the body 40 and travels through the removed section 42 (FIG. 2) to the target area directly in front of the light source. Light from the light source 16 also passes through the translucent holder 18 and then onto the target area. If the intermediate planar wall 58 and the outer planar walls 52 have roughness applied (diffuse translucent) then some scattered light also irradiates the area of the target directly in front of the LED.

Light that passes through the flat top surface 72 can also spill over into a neighboring target zone and contribute to the illumination of the neighboring target zone, which is depicted in FIG. 6 as the x-dimension between 15 and 30 inches. Light from the light source 16 also refracts through the surface defined by the extending cup-shaped recess 46 then reflects by TIR off of the surface-defined by the peripheral side wall 44 and then passes through the extruded Fresnel optics 70 and is spread into the target area between the center of the target and the target area directly in front of the light source 16. Light from the light source 16 also refracts through the surface defined by the concave portion 48 and then passes through the extruded Fresnel optics 70 and is spread into the area between the center of the target and the area of the target directly in front of the light source 16. If the outer surfaces 52 and/or the intermediate surface 58 is polished or has a reflective coating applied, then light from the source 16 refracts through the surface defined by the extending cup-shaped recess 46, then reflects by TIR off the surface defined by the peripheral side wall 44, then reflects off either planar surface 52 or 58 (by reflection off the coating or by TIR), then refracts through one of the top surfaces, either the Fresnel optics 70 or the flat surface 72 and then passes to the area of the target between the center of the target and the target area directly in front of the light source 16.

Pointing a typical optic towards the center of the target, collecting and then spreading the light creates a desirable beam pattern in the center of the target, but very limited light at the area in front of the LED, which is the area adjacent the point on a line perpendicular to the target area and passing through the light source. By removing a portion of the optic and using a clear optic holder, light is purposely allowed to enter the area in front of the LED directly and in a controlled manner to add to the central area light. The optical body 40 and the facets 70 formed on a top surface thereof collimate and direct the light away from the mullion. By having a clear optical support, which can also be replaced by other supports such as posts that allow for unimpeded light to contact the target area in front of the LED, direct incident light can illuminate the area directly in front of the LED.

The optic and optic holder have been described with reference to preferred embodiments. Obviously, modifications and alterations will occur to others upon reading and understanding the preceding detailed description. The invention, which is limited only by the appended claims, is intended to cover all such modifications and alterations that come within the scope of the appended claims and the equivalents thereof.

The invention claimed is:

1. An apparatus for distributing light from a light source, the apparatus comprising:

a support; and an optic supported by the support, the optic comprising a truncated axially symmetric body having a section removed from the body defining a removed section from a top to a bottom of the body.

2. The apparatus of claim 1, wherein the transparent side wall is axially symmetric.

3. The apparatus of claim 1, wherein the support includes a base wall having an opening for receiving the associated light source.

4. The apparatus of claim 1, wherein the body includes a truncated generally axially symmetric side wall and at least one planar wall.

5. The apparatus of claim 4, wherein the at least one planar side wall is glazed.

6. The apparatus of claim 1, wherein the body includes a plurality of facets formed on a top surface.

7. A method for illuminating a target plane, the method comprising:

placing an optic over a light source, wherein the optic comprises a truncated generally axially symmetrical body defined around a first axis, the body having a removed section;

passing light from the light source through the optic onto a target plane on an opposite side of the optic from the light source; and directing light from the light source directly onto the target plane through the removed section bypassing the optic.

8. The method of claim 7, further comprising placing a support around the light source to support the optic.

9. The method of claim 8, further comprising positioning the light source adjacent an end of the optic along the first axis.

10. An assembly for directing light comprising:

a support; and an optical body mounted on the support, the optical body comprising a truncated generally axially symmetric peripheral wall and at least two other peripheral walls each abutting the truncated generally axially symmetric peripheral wall, wherein the body is truncated with respect to its axial symmetry to define a removed section to allow first incident light from an associated light source to be directed in front of the associated light source without passing through the body.

11. The assembly of claim 10, wherein the optical body includes a light-emitting surface normal to a central axis about which the truncated generally axially symmetric peripheral wall is centered, the light-emitting surface including a plurality of facets.

12. The assembly of claim 11, wherein at least one of the plurality of facets is substantially parallel to the at least one other peripheral wall.

13. The assembly of claim 10, wherein the support includes a cylindrical side wall.

14. The assembly of claim 13, wherein the side wall of the support is transparent.

15. The assembly of claim 10, wherein the at least one other peripheral wall includes a surface having light diffusing properties.

* * * * *